United States Patent [19]

Jolivet

[11] 4,334,488

[45] Jun. 15, 1982

[54] FIXTURE FOR ATTACHING THE WISHBONE TO THE MAST OF A SAIL-BOARD

[76] Inventor: Christiane Jolivet, 23, rue Salvador Allende, 76610 Le Havre, France

[21] Appl. No.: 110,312

[22] Filed: Jan. 8, 1980

[51] Int. Cl.[3] ..... B63H 9/04; B63H 9/08

[52] U.S. Cl. ..... 114/39; 114/97

[58] Field of Search ..... 114/97, 39, 91, 89, 114/90, 94, 98, 100, 102, 113-115; 9/310 E

[56] References Cited

U.S. PATENT DOCUMENTS 3,487,800 1/1970 Schweitzer et al. ..... 114/91 X 3,996,868 12/1976 Schager ..... 114/39

FOREIGN PATENT DOCUMENTS 2700586 7/1977 Fed. Rep. of Germany ..... 9/310 E

OTHER PUBLICATIONS

WO79/01078, 12/79 Based on PCT/DE79/00049, Hans Christian Marker.

*Primary Examiner*—Douglas C. Butler

*Attorney, Agent, or Firm*—Karl W. Flocks

[57] ABSTRACT

Fixture for attaching a wishbone element to a mast of a sheet of sail on a sail-board comprising a unitary member having a pair of holes or sockets at one end thereof for reception and retention of free ends of a wishbone element to be assembled therewith, a notch with a cylindrical surface extending between and separating the pair of holes or sockets whereby a portion of a mast may be retained in seated relationship against the notch, and a hook extending from one side of the unitary member over which a loop of a semi-elastic strap securing a mast in slip-knot manner may be readily passed and be effectively retained thereby.

2 Claims, 12 Drawing Figures

FIXTURE FOR ATTACHING THE WISHBONE TO THE MAST OF A SAIL-BOARD

The invention relates to a part concerning the rigging of a sail board.

There has existed for several years now the nautical sport, the aim of which is to balance on an elongated canoe-shaped hollow board, consisting basically of a mast and a sail.

This sail is kept constantly taut by means of a ring of a very elongated shape and called a "wishbone". This ring, which encircles the sail, replaces the boom of conventional rigging; it is used by the "sailor" when he performs the various maneuvers necessary to steer a sail boat.

The attachment of the wishbone to the mast made in a conventional manner with rings and ropes is accompanied by inconveniences such as the typing of the so-called "capstan" knot, the difficulty of unduing it especially when the rope is wet, the necessity of having a wedging pin to retain any excess rope, a certain amount of give between the mast and the wishbone, loss of time, etc.

The device, object of the invention, relates to a very simple fixture, which enables a good coupling of the mast with the wishbone, and moreover without any knot.

Figure 1:
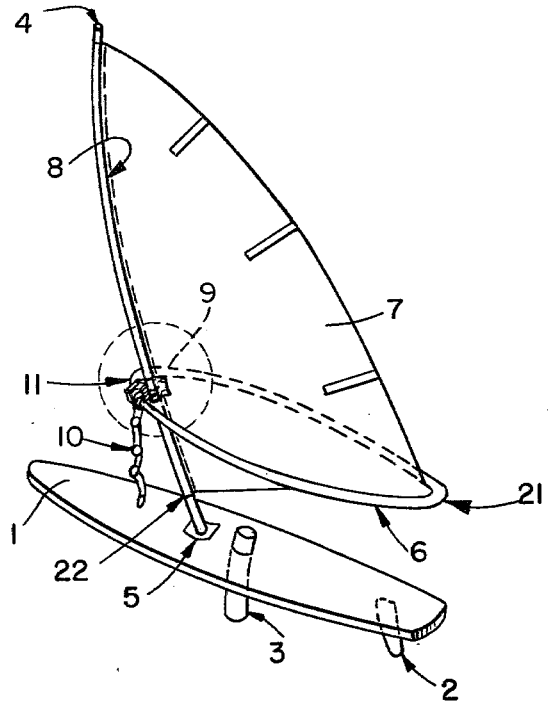
Figure 2:
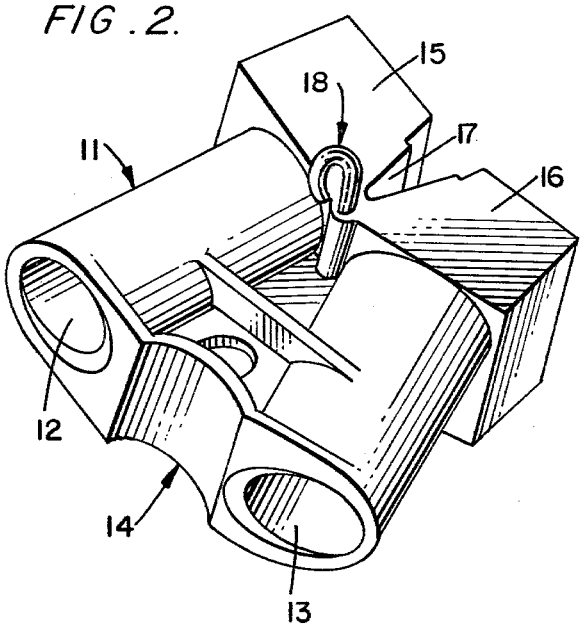
Figure 3:
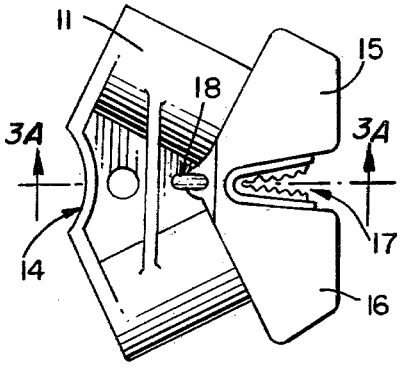
Figure 3A:
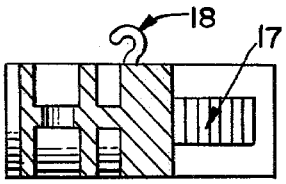
Figure 9:
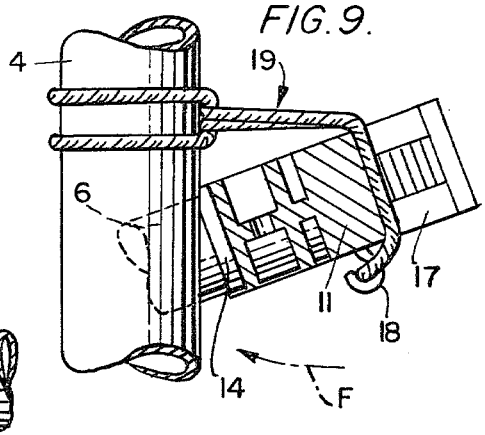
Figure 10:
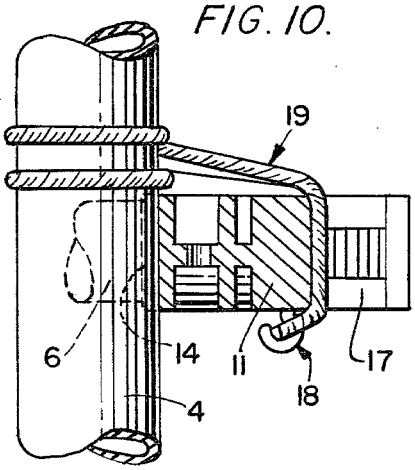
Figure 11:
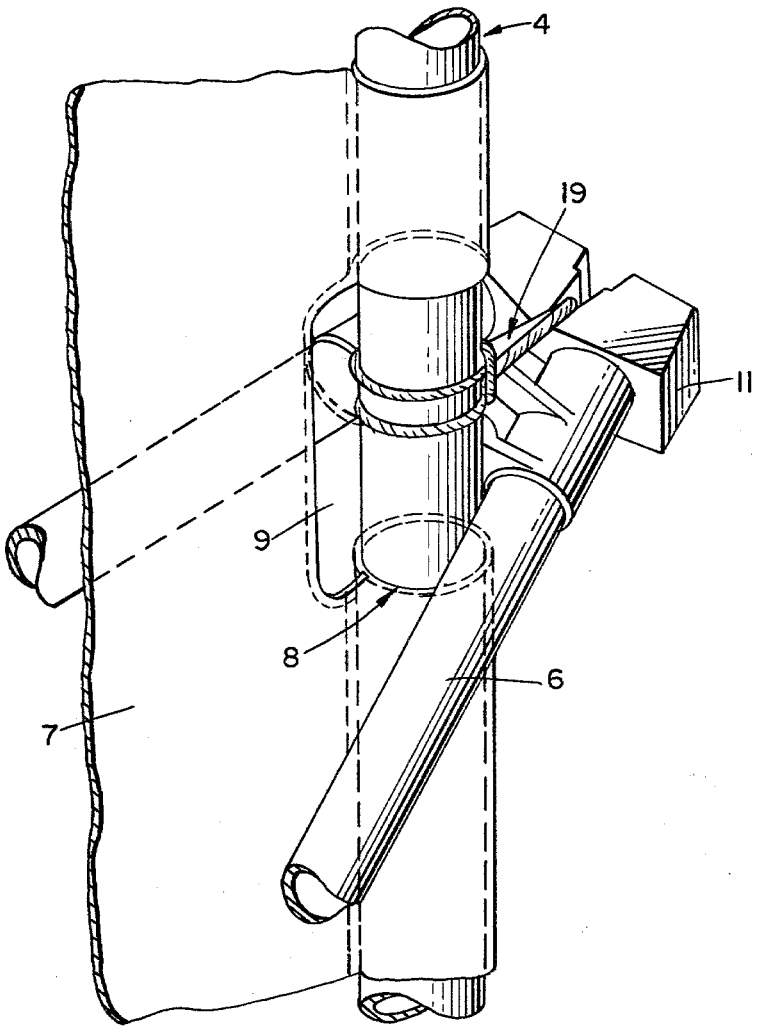

In a non-limitative method of construction set out as an example only, the following drawings show in:

FIG. 1 the complete sail-board according to the invention in perspective;

FIG. 2 the fixture for attaching the wishbone to the mast;

FIG. 3 on a reduced scale, the preceding fixture;

FIG. 3A a ground-plan at its upper part, in a cross-section through a right-angled plane of line 3A—3A in FIG. 3 in its lower part;

FIGS. 4, 5, 6, 7, 8, 9 and 10 the method steps of fixing to the mast the fixture shown in FIG. 2; and FIG. 11 the fully-assembled device in perspective, including mast, coupling fixture and wishbone after they have been placed in position.

As may be seen in FIG. 1 the board 1, which is fitted with its rigging, comprises a fixed fin 2, and a removable keel 3, these accessories being indispensable to the stability of the sealing device during its progression under a cross wind.

On top of the board 1, are to be found the mast 4 fixed to the board 1 by a swivel joint (ball coupling) 5, and finally the wishbone 6 encircling the sail 7. The edge of the sail 7 which touches the mast is fitted with a sheath 8 that is formed by a hem of the sail. It is in this sheath that the mast is engaged in such a manner that the sail is supported along its entire length. The hem 8 comprises an opening 9 at the place where the wishbone is fixed to the mast, this spot is indicated in FIG. 1 by a dotted circle. It is from here too that a small length of knotted rope 10, called the hoisting line, and used for righting the sail when it has been down in the water.

FIG. 2 shows in perspective the fixture 11 attaching the wishbone to the mast which consists of two tubular parts 12 and 13 in which are fitted the two free front ends of the wishbone, which are in the shape of a "V". Between the tubular parts 12 and 13, there is a cylindrical notch, in which the portion of the mast 4 is inserted when part 11 is in place. At the end of part 11, opposite from the tubular openings 12 and 13, there are two flexible blocks 15 and 16, separated by a gap 17. At the end of this gap, there is a belaying hook 18, one end of which is buried in the thickness of the fixture. The whole construction forms a monobloc, although the tubular parts are of a rigid material and the blocks 15 and 16 of a relatively supple substance.

FIG. 3 shows in its upper part the fixture 11 for attaching the wishbone, which is seen in ground-plan. One can see notch 14, blocks 15 and 16, separated by gap 17, as well as hook 18.

The lower part of FIG. 3 shows a cross-section of the middle part of fixture 11 through a right-angled plane, along dotted line a,b. The position of hook 18 is readily seen, as well as that of gap 17. It is according to this cross-section diagram that will be indicated the method of fixing part 11 to mast 4.

FIGS. 4 to 10 depict the manner of fixing of part 11 to the mast 4 the sail-board. This is carried out by means of a semi-elasticated circular strap 19.

Figure 4:
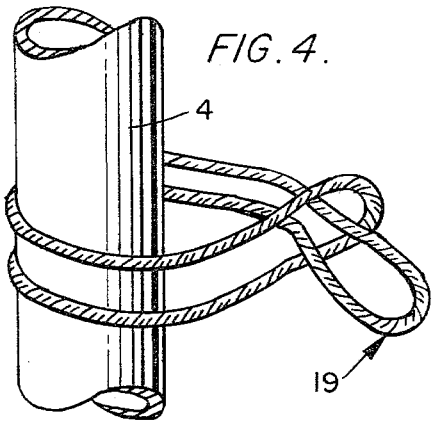

In FIG. 4 one can see this strap 19 tightly encircling the mast by a simple slip-knot.

Figure 5:
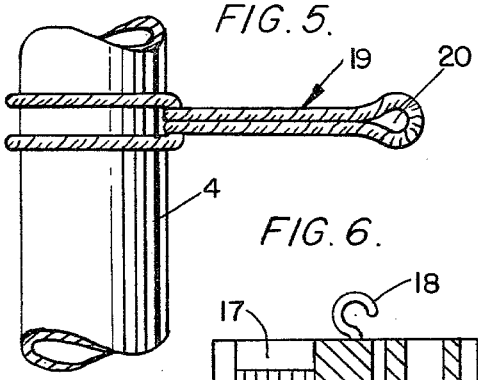
Figure 6:
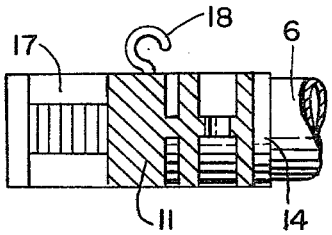
Figure 7:
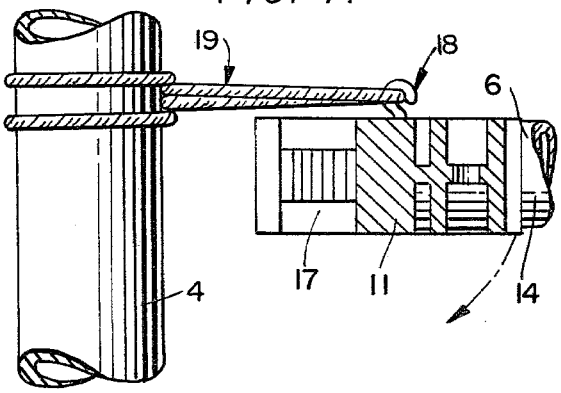

This first operation being performed, one pulls on the free end of the slip-knot to tighten it and to bring its final loop 20 in front of hook 18 of fixture 11. This is what is shown in FIGS. 5 and 6. This is also what FIG. 7 shows, after the hooking up; it is necessary to note here that the gap 17 is turned to face mast 4.

The following operation consists in tilting the whole about the hook 18 in the direction of the arrow F whilst keeping the strap pulled very taut.

Figure 8:
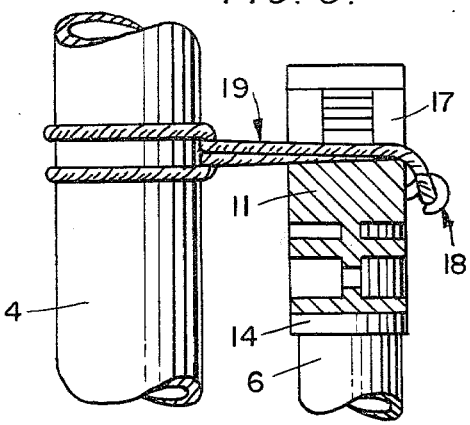

FIG. 8 shows the first part of this rotation, the fixture which attaches the wishbone having been subjected to a quarter of a rotation, strap 19 is engaged in gap 17 where it is wedged inside a toothed "V".

In FIG. 9 the rotation movement, shown by arrow F is accentuated and fixture 11, attaching the wishbone has almost done a half-rotation; it then comes up against mast 4 and the latter comes to fit into the cylindrical notch 14.

In FIG. 10, part 11 is set in place and takes up a position perpendicular to mast 4. In order for this to happen, it was necessary to force the semi-elasticated strap 19 and to obtain a certain extension thereof. If this proves too difficult, it is possible to put the wishbone in place by slipping its ends into holes 12 and 13 (See FIG. 2), after this manoeuvre, it is easy to use the wishbone as a lever.

The last FIG. 11 shows everything assembled. Part 11 attaching the wishbone is blocked against mast 4 by strap 19 and the ends of the wishbone 6 placed in holes 12 and 13 of part 11 (See FIG. 2).

Under no circumstances can the wishbone become disengaged since it is constantly drawn against the coupling fixture 11 by the pressure of sail 7, which, for its part, is firmly fixed to mast 4 by its junction point 22 with the latter. At point 21, there is the coupling between sail 7 and wishbone 6 (See FIG. 1).

This coupling of the wishbone to the mast is simpler than that method which uses a rope. It is drawn into position more rapidly and guarantees its anchoring without any give between the mast and the wishbone, which provides for a more precise adjustment of the sail.

A variation of the invention producing the same effects will be obtained by replacing the semi-elasticated strap by an inextensible coupling and by interpolating between the mast and the internal face of the frame of the wishbone a flexible pad or cushion, the compression of which will assure the good holding together of the assembly.

I claim:

1. Fixture for attaching a wishbone element to a mast of a sheet of sail on a sail-board comprising a unitary member having a pair of holes or sockets at one end thereof for reception and retention of free ends of the wishbone element to be assembled therewith and an endless flexible strap: wherein said unitary member includes a notch with a cylindrical surface extending between and separating said pair of holes or sockets, first and second sides extending radially away from said notch, a gap extending between said first and second sides and facing away from said notch, and a hook extending from said second side with said hook being open in the direction toward said notch and away from said gap; also wherein said endless flexible strap includes two side-by-side portions with opposite ends thereof being integral with each other in first and second closed loops; and further wherein in assembly of the wishbone element on the mast said cylindrical surface of said notch is placed against a portion of the mast which is retained therein in seated relationship, the free ends of the wishbone element are disposed in said holes or sockets of said unitary member and retained therein, said endless flexible member is wrapped with both of said side-by-side portions around said mast, with said first closed loop passed inward of said second closed loop and said mast in slip knot fashion, with said first closed loop being drawn tightly beyond said first radially extending side of said unitary member, turned substantially vertically through and against said gap, turned back toward said mast at said second radially extending side of said unitary member, with said first closed loop disposed in and retained in said hook, and with said endless strap being in taut condition.

2. The fixture as defined in claim 1 wherein the semi-elastic strap is annular.

* * * * *